United States Patent [19]

Kircher

[11] 4,124,786

[45] Nov. 7, 1978

[54] SPEAKER COMPARATOR DEVICES AND METHODS OF MAKING AND USING THE SAME

[76] Inventor: John C. Kircher, 9929 Norwick, St. Louis, Mo. 63137

[21] Appl. No.: 761,204

[22] Filed: Jan. 21, 1977

[51] Int. Cl.[2] ..... H04R 29/00

[52] U.S. Cl. ..... 179/175.1 A; 179/1 G

[58] Field of Search ..... 179/175.1 A, 1 VL, 1 B, 179/1 G, 1 AT

[56] References Cited

U.S. PATENT DOCUMENTS

| | | | |
|---|---|---|---|
| 2,224,909 | 12/1940 | Hackley | 179/175.1 A |
| 2,489,008 | 11/1949 | Callender | 179/1 B |
| 3,784,748 | 1/1974 | Brinkerhoff | 179/1 VL |

*Primary Examiner*—Douglas W. Olms

[57] ABSTRACT

The present invention relates to a passive speaker comparator which allows performance comparison of various speakers utilizing the same program source at the same listening volume level in an audio system providing an audio source and various preamplifying and amplifying gain stages, comprising, housing means, an impedance matching network operably mounted on said housing means, a plurality of adjustable attenuators operably mounted on said housing means and connected electrically to said impedance matching network, said network and attenuators disposed electrically between the appropriate preamplifier and amplifier gain stages, a plurality of attenuator switching means operably coupled to said network and, a plurality of speaker switching means operably connected to the output of the appropriate amplification stage and a plurality of speaker connector means operably connected to said speaker switching means, such that a preset attenuator is disposed between the appropriate preamplifier stage and the appropriate amplifier stage at the same time as a selected speaker or speakers connected to the speaker connector means is connected to the appropriate amplifier stage by the said speaker switching means.

8 Claims, 4 Drawing Figures

SPEAKER COMPARATOR DEVICES AND METHODS OF MAKING AND USING THE SAME

BACKGROUND OF THE INVENTION

In many audio display situations it is desirable to compare the performance of a plurality of high fidelity speakers under listening conditions that are essentially the same. Compensation may be required to adjust for changes in listening volume when comparing speakers of differing efficiency. Comparison devices presently available are of limited utility in that some have no provision for listening volume compensation. Other devices use active amplifier stages which are complex, expensive and may introduce distortion into the amplification stages of the audio system provided to drive the speakers. Other devices compensation means may electrically affect the interface between amplifier and speaker and thus cause a change of sound quality from the speaker as listening volume is adjusted by the device.

SUMMARY OF THE INVENTION

It is therefore an object of the present invention to provide a device which provides facilities for testing a plurality of speakers with a passive device by a listening comparison which introduces a negligible amount of distortion and a repeatable preset volume level. In its preferred embodiment the present invention contemplates use with an audio system wherein an electrical signal from a pre-amplifier or gainstage typically is coupled to an adjustable network provided in the present invention. This network includes an impedance matching circuit as well as a plurality of adjustable volume control networks that may be switched into the signal path between the pre-amplifier or gainstage and amplifier. The electrical output of this amplifier is then typically fed through switching means to an array of speaker connections. It is contemplated that an independent adjustable volume control network will be provided for each speaker connection.

The primary objective is to provide such a device which introduces no sound quality change and in particular when speakers are compared at the same listening level.

A further object is to provide such a device which is passive and simply and economically manufactured and used.

A further object is to provide such a device such that no distortion is introduced by the device.

A further objective is to provide such a device which will not interfere with or alter the amplifier speaker damping.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 1:
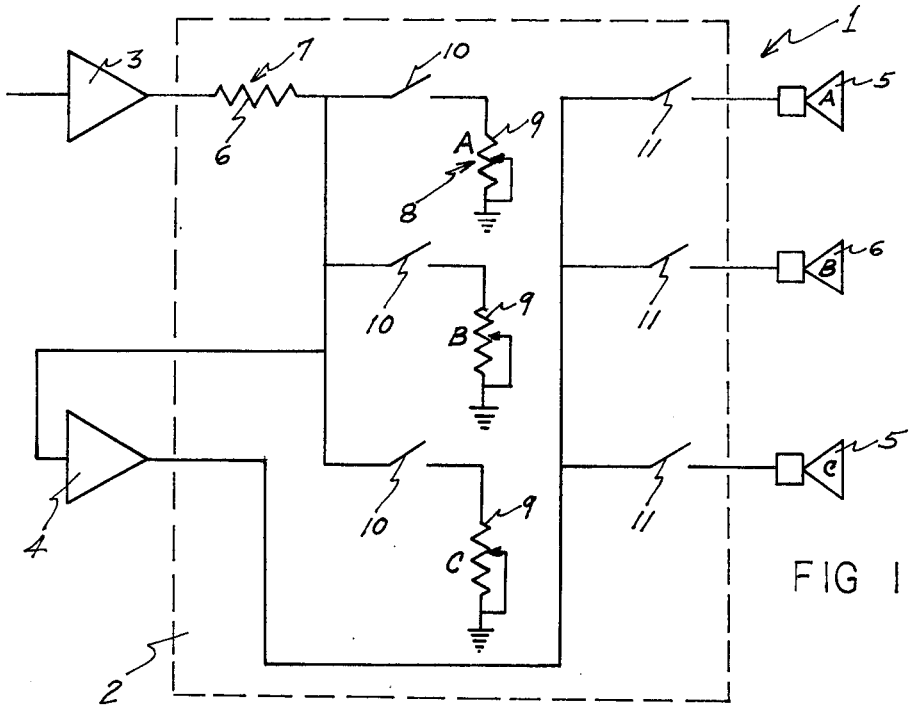
FIG. 1 is a schematic diagram of a speaker comparator constructed in accordance with and embodying the present invention as used in a monaural system.
Figure 2:
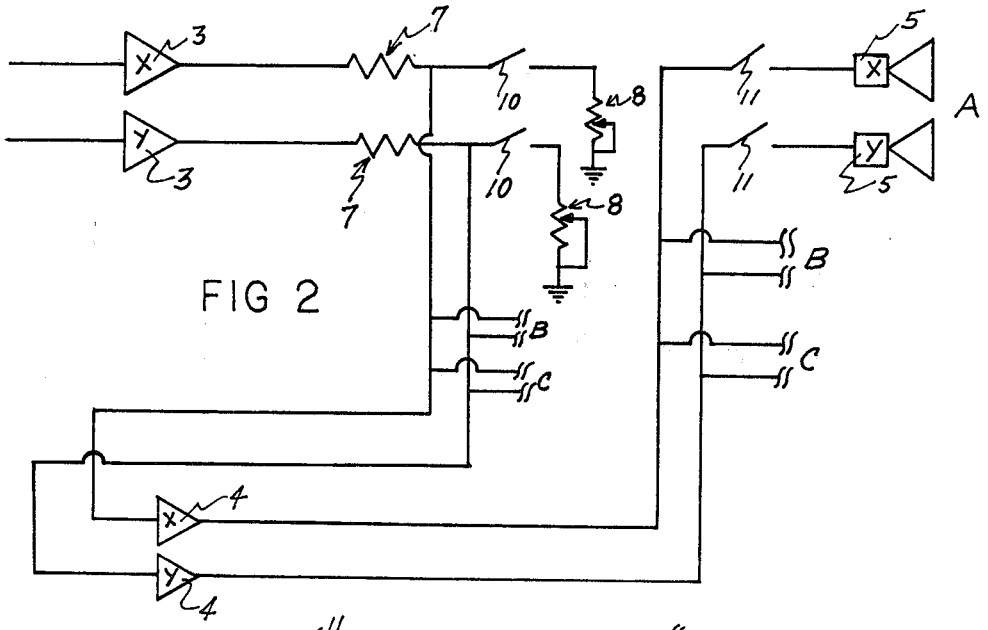
FIG. 2 is a partial schematic diagram of the embodiment shown in FIG. 1 as used in a two channel system.
Figure 3:
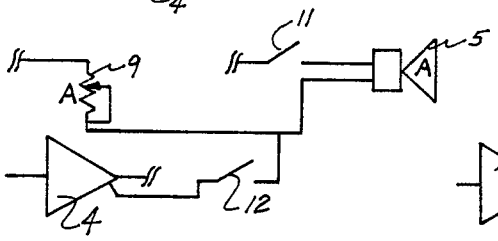
FIG. 3 is a partial schematic diagram of another embodiment of the present invention constructed in accordance with and embodying the present invention.
Figure 4:
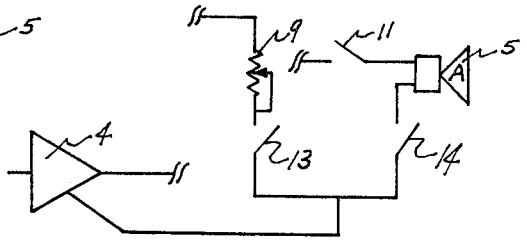
FIG. 4 is a partial schematic diagram of a further embodiment of the present invention constructed in accordance with and embodying the present invention.

Referring now in more detail and by reference characters to the drawings which illustrate practical embodiments of the present invention, FIGS. 1, 2, 3, and, 4, illustrate speaker comparators constructed in accordance with and embodying the present invention. FIG. 1 and FIG. 2 illustrate a first embodiment in a single and two channel system and FIG. 3 and FIG. 4 illustrate a second and third embodiment. It is clear that these embodiments are readily and obviously extended to systems with more than one or two channels.

As shown schematically in FIG. 1 the present invention comparator, 1, comprises a suitable base or housing means, 2, disposed operably with respect to the corresponding preamplifiers or preamplifying gain stages, 3, amplifiers or amplifying gain stages, 4, and speakers, 5, upon which is mounted impedance matching network, 7, which in FIG. 1 consists of series resistor, 6, adjustable attenuators, 8, which in FIG. 1 consists of variable resistors, 9, network switching means, 10, and speaker switching means, 11.

As shown in FIG. 1, when speaker, A, is tested the corresponding switch, 11, is closed. Coupled to switch, 11, is a corresponding network switch, 10, which inserts the appropriate attenuator, 8, into the path between the preamplifier, 3, and amplifier, 4, for its corresponding speaker. Each network is preset using the corresponding speaker to allow the same listening level output from the speakers A, B, and C as they are switched in and out of the system.

FIG. 2 illustrates the embodiment of FIG. 1 in a two channel system with channels X and Y for configurations using speaker pairs A, B and C.

FIG. 3 illustrates an alternate embodiment which relates primarily to a floating ground system. In this embodiment switches, 10, are eliminated and connection is made directly from the switch side of impedance matches, 7, to the high sides of attenuators, 8. The lower end of attenuators, 8, are now connected to the lower end of the corresponding speaker, 5, and by means of switch, 12, they are connected to the low side of the output of amplifier, 4, switched in and out to one side of a corresponding speaker.

FIG. 4 illustrates an alternate embodiment to that shown in FIG. 3 in that switch, 12, is now eliminated and switches, 13, and, 14, are used to connect the low sides of attenuators, 8, and speakers, 5, to the low side of amplifier, 4.

It should be clear that the embodiments shown illustrate a series resistor for impedance matches, 7, and a variable resistor for attenuator, 8, but that depending upon the particular application it is contemplated that these may be replaced individually by T-networks, PI-networks, and the like comprising resistive elements alone or including resistive and/or inductive and capacitive elements.

It should be understood that changes and modifications in the form, construction, arrangement, and combination of the Speaker Comparator Device and methods of making and using the same may be made and substituted for those herein shown and described without departing from the nature and principle of my invention.

I claim:

1. A speaker comparator to allow performance comparison of various speakers utilizing the same input and at the same volume level in a system or equipment provided with preamplifying gain stage and an amplifying gain stage comprising,

- housing means,
- a plurality of speaker connection terminals operably mounted to said housing means,
- a plurality of attenuators operably mounted to said housing means,
- first switching means operably mounted on said housing means and electrically disposed so as to selectively connect a particular attenuator to the input of said amplifying stage,
- an impedance matching means operably mounted to said housing means and disposed between said preamplifying and amplifying gain stages, and electrically connected to the output of said preamplifier and to said first switching means,
- second switching means operably mounted on said housing means and electrically disposed so as to selectively connect a particular speaker terminal to the output of the amplifying gain stage.

2. A speaker comparator as described in claim 1 wherein said first and second switching means are coupled together to provide simultaneous actuation thereof.

3. A speaker comparator as described in claim 1 wherein said attenuators are adjustable.

4. A speaker comparator as described in claim 1 wherein said first switching means are connected between said attenuators and impedance matching means.

5. A speaker comparator as described in claim 1 wherein said impedance matching means comprises a plurality of impedance matching means each of which is connected directly to the corresponding attenuator.

6. A speaker comparator as described in claim 1 wherein said switch means are mounted mechanically away from said housing means.

7. A speaker comparator as described in claim 1 wherein said amplifying stage contains electrical isolation means.

8. A speaker comparator as described in claim 1 wherein said first and second switching means are connected such that a particular attenuator is selected when a particular speaker terminal is selected.

* * * * *